US011177598B2

(12) United States Patent
Chi

(10) Patent No.: US 11,177,598 B2
(45) Date of Patent: Nov. 16, 2021

(54) FULL-SHIELDING CABLE CONNECTOR AND CABLE PLUG THEREOF

(71) Applicant: BELLWETHER ELECTRONIC CORP., Taoyuan (TW)

(72) Inventor: Yung-Liang Chi, Taoyuan (TW)

(73) Assignee: BELLWETHER ELECTRONIC CORP., Taoyuan (TW)

( * ) Notice: Subject to any disclaimer, the term of this patent is extended or adjusted under 35 U.S.C. 154(b) by 0 days.

(21) Appl. No.: 16/924,189

(22) Filed: Jul. 9, 2020

(65) Prior Publication Data

US 2021/0013651 A1 Jan. 14, 2021

Related U.S. Application Data

(60) Provisional application No. 62/872,366, filed on Jul. 10, 2019.

(51) Int. Cl.

| | |
|---|---|
| ***H01R 12/79*** | (2011.01) |
| ***H01R 12/57*** | (2011.01) |
| ***H01R 13/6593*** | (2011.01) |
| ***H01R 13/629*** | (2006.01) |

(52) U.S. Cl.

CPC ..... *H01R 12/79* (2013.01); *H01R 12/57* (2013.01); *H01R 13/62933* (2013.01); *H01R 13/6593* (2013.01)

(58) Field of Classification Search

CPC ..... H01R 13/6592; H01R 13/6593; H01R 13/6594; H01R 13/6595; H01R 13/62933; H01R 12/79; H01R 12/57

USPC ..... 439/497, 607.41, 607.35, 607.36, 607.4

See application file for complete search history.

(56) References Cited

U.S. PATENT DOCUMENTS

| | | | | |
|---|---|---|---|---|
| 6,755,687 | B1 * | 6/2004 | Ko | H01R 4/024 439/579 |
| 7,220,146 | B2 * | 5/2007 | Miyazaki | H01R 9/0527 439/402 |
| 7,377,803 | B2 * | 5/2008 | Matsuoka | H01R 12/592 439/497 |
| 7,402,070 | B1 * | 7/2008 | Wu | H01R 13/635 439/152 |
| 7,722,387 | B2 * | 5/2010 | Yamaji | H01R 23/6873 439/497 |

(Continued)

FOREIGN PATENT DOCUMENTS

| | | |
|---|---|---|
| CN | 203850468 U | 9/2014 |
| TW | I621309 B | 4/2018 |

*Primary Examiner* — Gary F Paumen

(74) *Attorney, Agent, or Firm* — Li & Cai Intellectual Property Office

(57) ABSTRACT

A full-shielding cable connector includes an insulated body, a metal frame, a shielding conductive body, and a pull rod. The insulated body has a plurality of terminal slots for receiving a plurality of terminals, respectively. The metal frame is fixed to the insulated body. The metal frame has pins that are electrically connected to a grounding circuit of a circuit board. The shielding conductive body is detachably assembled to the insulated body and arranged above the metal frame. The shielding conductive body has a cable receiving chamber for receiving a cable, and contacts a top and bottom surface of the cable. The pull rod is rotatable with respect to the shielding conductive body. The pull rod can be rotated to a front end of the insulated body to be fastened thereto.

16 Claims, 12 Drawing Sheets

(56) References Cited

U.S. PATENT DOCUMENTS

| | | | | |
|---|---|---|---|---|
| 8,043,114 | B2 * | 10/2011 | Kaneko | H01R 12/716 439/497 |
| 8,608,504 | B2 * | 12/2013 | Tseng | H01R 13/6471 439/497 |
| 2007/0141909 | A1 * | 6/2007 | Nagata | H01R 13/65917 439/607.41 |
| 2010/0029133 | A1 * | 2/2010 | Cheng | H01R 9/038 439/607.47 |
| 2010/0144199 | A1 * | 6/2010 | Wu | H01R 13/65912 439/578 |
| 2013/0316566 | A1 * | 11/2013 | Little | H01R 12/00 439/378 |
| 2014/0187087 | A1 * | 7/2014 | Mason | H01R 13/6594 439/607.36 |

* cited by examiner

FULL-SHIELDING CABLE CONNECTOR AND CABLE PLUG THEREOF

CROSS-REFERENCE TO RELATED PATENT APPLICATION

This application claims priority to the U.S. Provisional Patent Application Ser. No. 62/872,366, filed on Jul. 10, 2019, which application is incorporated herein by reference in its entirety.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a cable connector and a combination thereof for connecting flexible flat cables (FFC) or flexible print circuits (FPC), and more particularly to a full-shielding cable connector and a combination thereof capable of improving electromagnetic interference (EMI) resistance.

BACKGROUND OF THE DISCLOSURE

Flexible flat cables (FFC) or flexible print circuits (FPC) are hereinafter both referred to as "cable" for the sake of brevity. Cables have been widely used in transmitting large quantities of data. In order to improve electromagnetic interference (EMI) resistance, a metal foil is usually adhered to an outer surface of a cable shielding layer. Since the shielding layer does not have a grounding circuit that is electrically contacted with the cable, an additional grounding process is required to ground the metal foil. Such additional grounding process is not only time-consuming, but also incurs high cost. Furthermore, this method does not ensure that the metal foil has a common ground with the shielding layer, a shell, and the grounding terminal of the cable.

In addition, another conventional method is to add the grounding terminal to the connector so that the grounding terminal is in contact with the shielding layer of the cable, and the entire cable is surrounded by the shielding layer. This method transfers costs to the manufacturer of the connector. In addition, in this method, only one side of the shielding layer is in contact with the grounding terminal of the connector, leading to a longer grounding passageway of the other side of the shielding layer on the cable.

Furthermore, in order to save space or use space effectively, when a conventional cable is electrically connected to a circuit board, the cable is parallel to the circuit board. Therefore, when a cable is installed to a cable connector on the circuit board, the cable is inserted into the cable connector along a direction parallel to the circuit board. This method of installing the cable by arranging the cable to the circuit board in an adjoining manner is not only difficult to implement, but also prone to cause a deviation of an insertion angle during installation and result in an erroneous installation.

Therefore, how an improved structural design can be provided to ensure the EMI resistance of the cable, so that the aforementioned shortcomings may be overcome, has become an important issue in this technical field.

SUMMARY OF THE DISCLOSURE

In response to the above-referenced technical inadequacies, the present disclosure provides a full-shielding cable connector and a cable plug thereof.

In one aspect, the present disclosure provides a full-shielding cable connector that is electrically connected to a circuit board. The full-shielding cable connector includes an insulated body, a plurality of terminals, a metal frame, a shielding conductive body, and a pull rod. The insulated body has a plurality of terminal slots formed along a first direction. The plurality of terminals is respectively received in the plurality of terminal slots, each of the plurality of terminals has a contact portion and a soldering portion, and the soldering portion is extended from the contact portion. The metal frame is fixed to the insulated body, and the metal frame has a plurality of pins so as to be electrically connected to the circuit board. The shielding conductive body is detachably assembled to the insulated body and is arranged above the metal frame, and the shielding conductive body has a cable entrance such that when a front end of a cable enters the shielding conductive body through the cable entrance, an upper shielding layer and a lower shielding layer of the cable are electrically connected to the shielding conductive body. The pull rod is rotatably connected to the shielding conductive body, and when the pull rod is rotated to a fastened position, the pull rod is fastened to the insulated body and so the shielding conductive body is fastened to the insulated body. When the shielding conductive body is assembled to the insulated body, the shielding conductive body is in physical contact with the metal frame.

In another aspect, the present disclosure provides a cable plug that is detachably assembled to a full-shielding cable connector that includes an insulated body and a metal frame, and the insulated body receives a plurality of terminals. The cable plug includes a shielding conductive body and a pull rod. The shielding conductive body is detachably assembled to the insulated body and arranged above the metal frame. The shielding conductive body has a front portion, a shielding top wall, and a pair of shielding side walls. The front portion, the shielding top wall, and the pair of shielding side walls have a cable receiving chamber formed therebetween. A cable entrance is formed on the front portion and contacts a bottom surface of the cable inserted therein, and the shielding top wall has a plurality of elastic arms formed thereon and extended inward into the cable receiving chamber such that the plurality of elastic arms contact a top surface of the cable. The pull rod is rotated with respect to the shielding conductive body. When the pull rod is rotated to a fastened position, the shielding conductive body is fastened to the insulated body. When the shielding conductive body is assembled to the insulated body, the front portion of the shielding conductive body is in physical contact with the metal frame.

In yet another aspect, the present disclosure provides a full-shielding cable connector that is electrically connected to a circuit board. The full-shielding cable connector includes a cable socket and a shielding conductive body. The cable socket includes an insulated body and a metal frame, and the insulated body receives a plurality of terminals. The shielding conductive body is detachably assembled to the cable socket, and the shielding conductive body includes a cable fixing portion to fix a cable inserted therein in place along a first direction. The cable socket has at least one guiding installation portion, and the shielding conductive body has at least one guided portion. When the shielding conductive body is assembled to the cable socket, the at least one guided portion, limited by the corresponding guiding installation portion, slides along a second direction for a predetermined distance. The second direction is perpendicular to the first direction.

Therefore, by the shielding conductive body and the metal frame being in physical contact with the shielding layers of the top surface and the bottom surface of the cable, the full-shielding cable connector of the present disclosure allows a good electrical connection between the cable and the grounding circuit of the circuit board, and achieves a full-shielding function that provides resistance against electromagnetic interference (EMI). The cable does not need to be additionally covered by extra metal foil, and the connector does not need additional grounding terminals to be in contact with the cable.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1A:
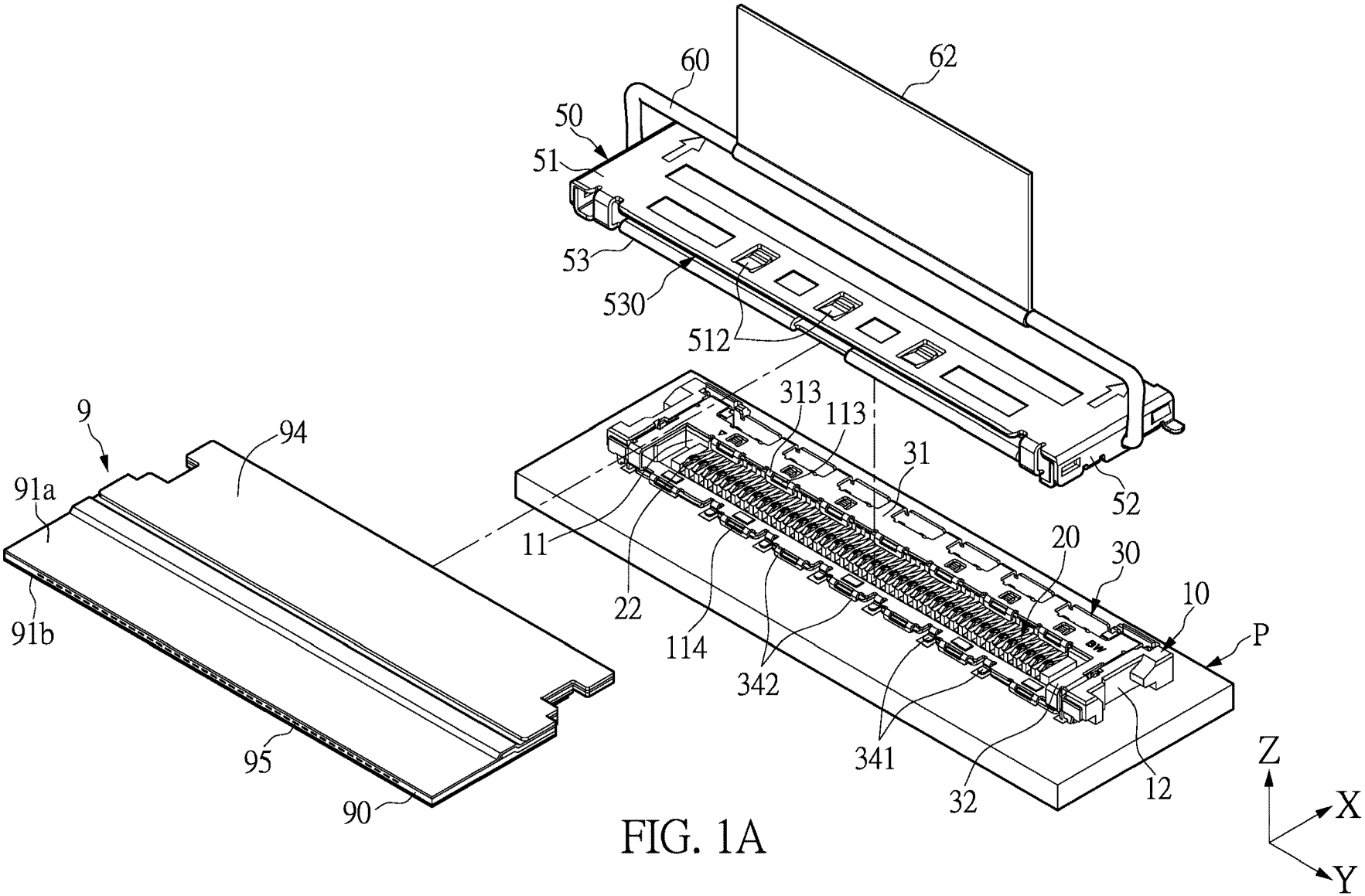
FIG. 1A is a perspective view of a full-shielding cable connector and a cable plug of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1A to FIG. 3, the present disclosure provides a full-shielding cable connector that is electrically connected to a circuit board P. The cable connector, short for a full-shielding cable connector, includes an insulated body 10, a plurality of terminals 20, a metal frame 30, a shielding conductive body 50, and a pull rod 60. The shielding conductive body 50 is a shell that is capable of receiving a cable 9, such that the cable 9 is electrically connected to the circuit board P through the plurality of terminals 20. The metal frame 30 is assembled to the insulated body 10, and may be a cable socket of the cable connector. The shielding conductive body 50 can be a cable plug that, in conjunction with the cable 9, insert into the cable socket.

The insulated body 10 of the present embodiment has a main portion 11 and a pair of shoulder portions 12, the pair of shoulder portions 12 are respectively connected to two opposite sides of the main portion 11, and the main portion 11 has a plurality of terminal slots 110 formed along a first direction. The first direction is a longitudinal direction of the cable 9, which is also a direction of the X-axis in the figures.

The plurality of terminals 20 are respectively received in the plurality of terminal slots 110, each of the plurality of terminals 20 has a contact portion 21 and a soldering portion 22, and the soldering portion 22 is extended from the contact portion 21. The terminals 20 are fixed in the terminal slots 110 in an interfering manner. For the sake of brevity in description, a direction in which the soldering portion 22 extends along is defined as a forward direction, and the contact portion 21 is positioned at a rear side of the soldering portion 22. The soldering portion 22 is fixed to a corresponding soldering pad on the circuit board P by soldering.

Figure 1B:
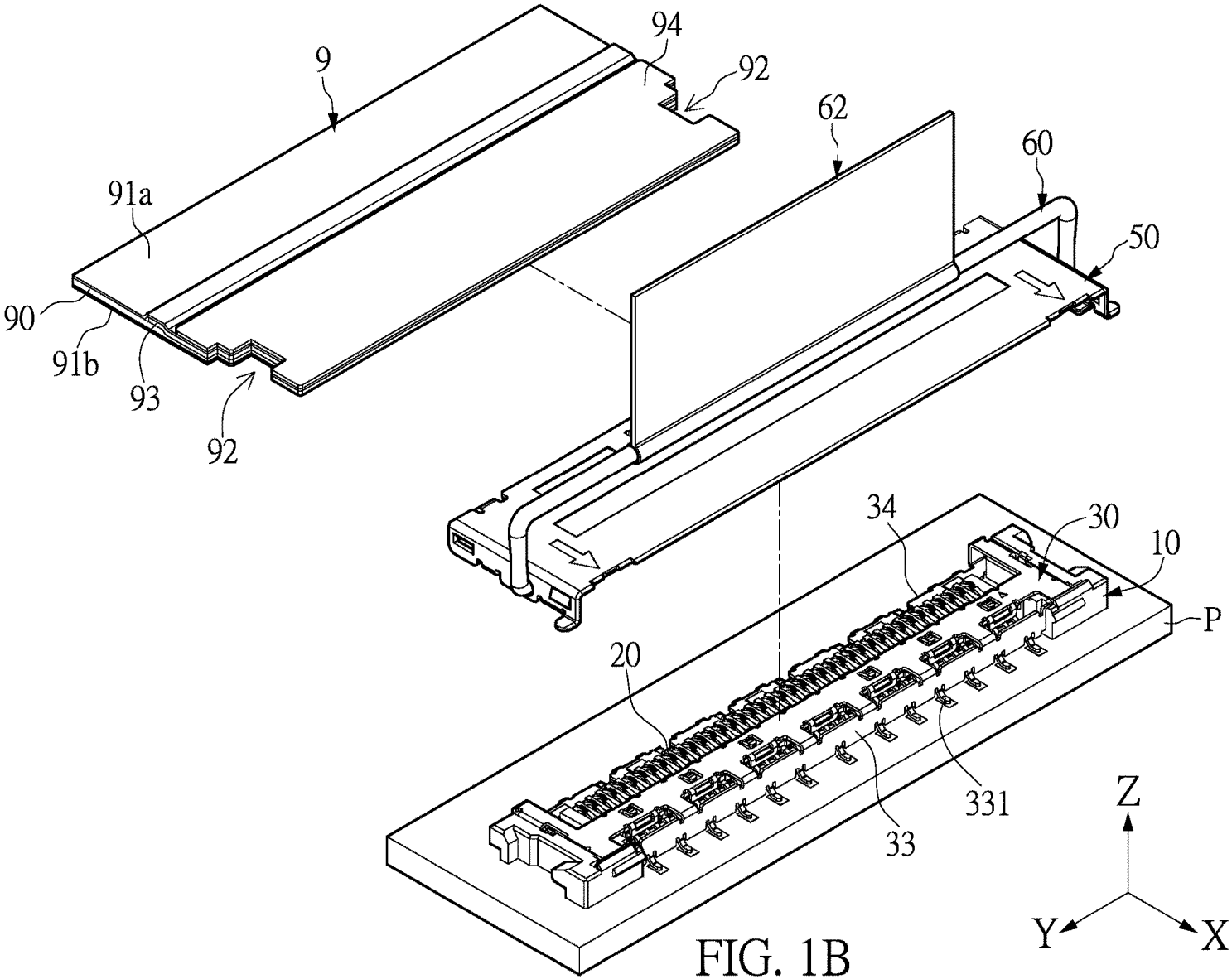
FIG. 1B is a perspective view taken from another angle of the cable connector and the cable plug of the present disclosure.

Referring to FIG. 1A and FIG. 1B, the metal frame 30 of the current embodiment is fixed to the insulated body 10. A manufacturing manner of the metal frame 30 may be through stamping of metal sheets. The metal frame 30 has a plurality of pins 331 and 341 that extend out of the plurality of terminals 20 and are electrically connected to the circuit board P. For example, the plurality of pins 331 and 341 are fixed to a grounding circuit (omitted in the figures) of the circuit board P or other common electrical potentials by soldering.

Figure 2:
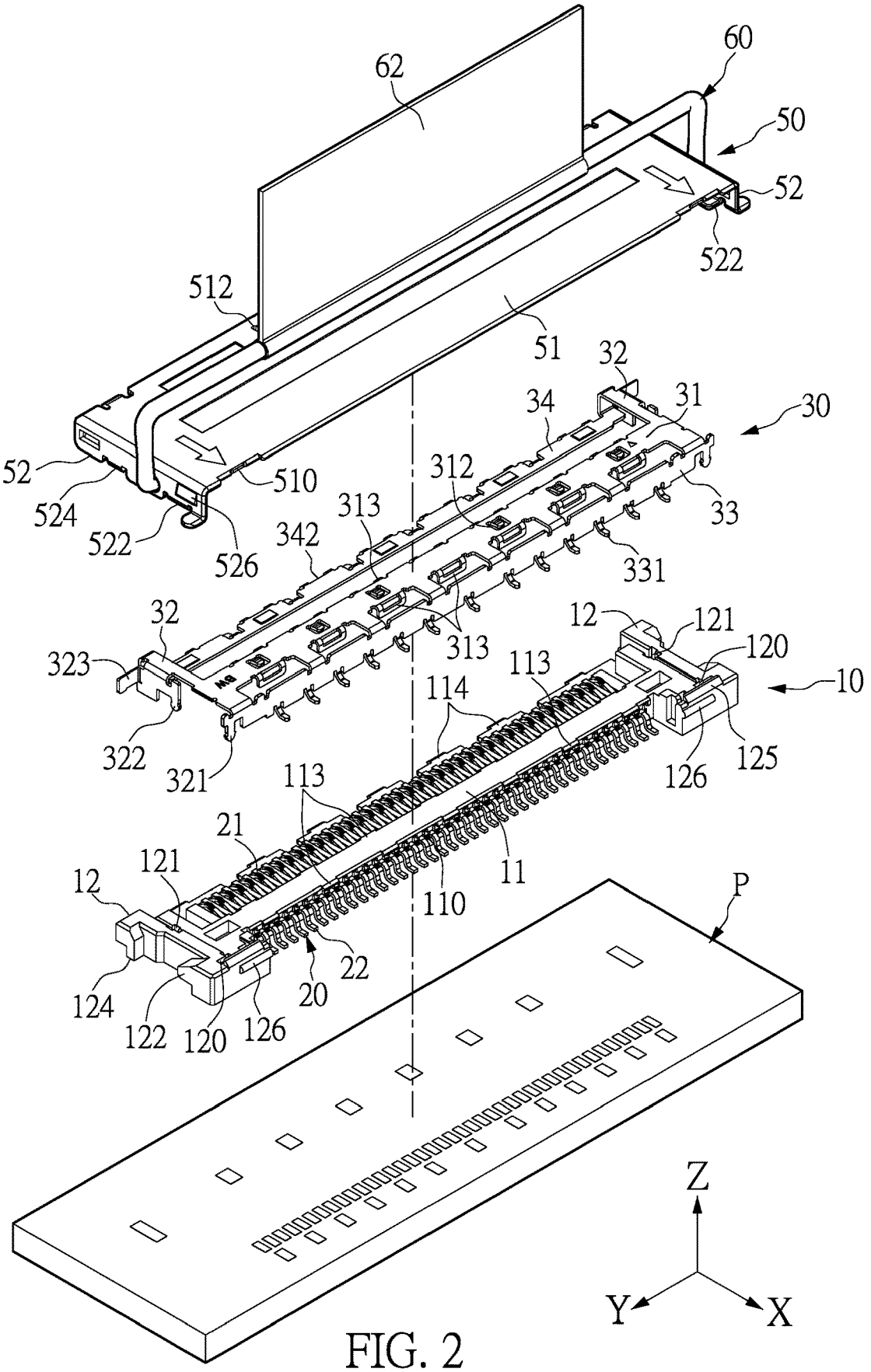
FIG. 2 is an exploded perspective view of the cable connector of the present disclosure.
Figure 3:
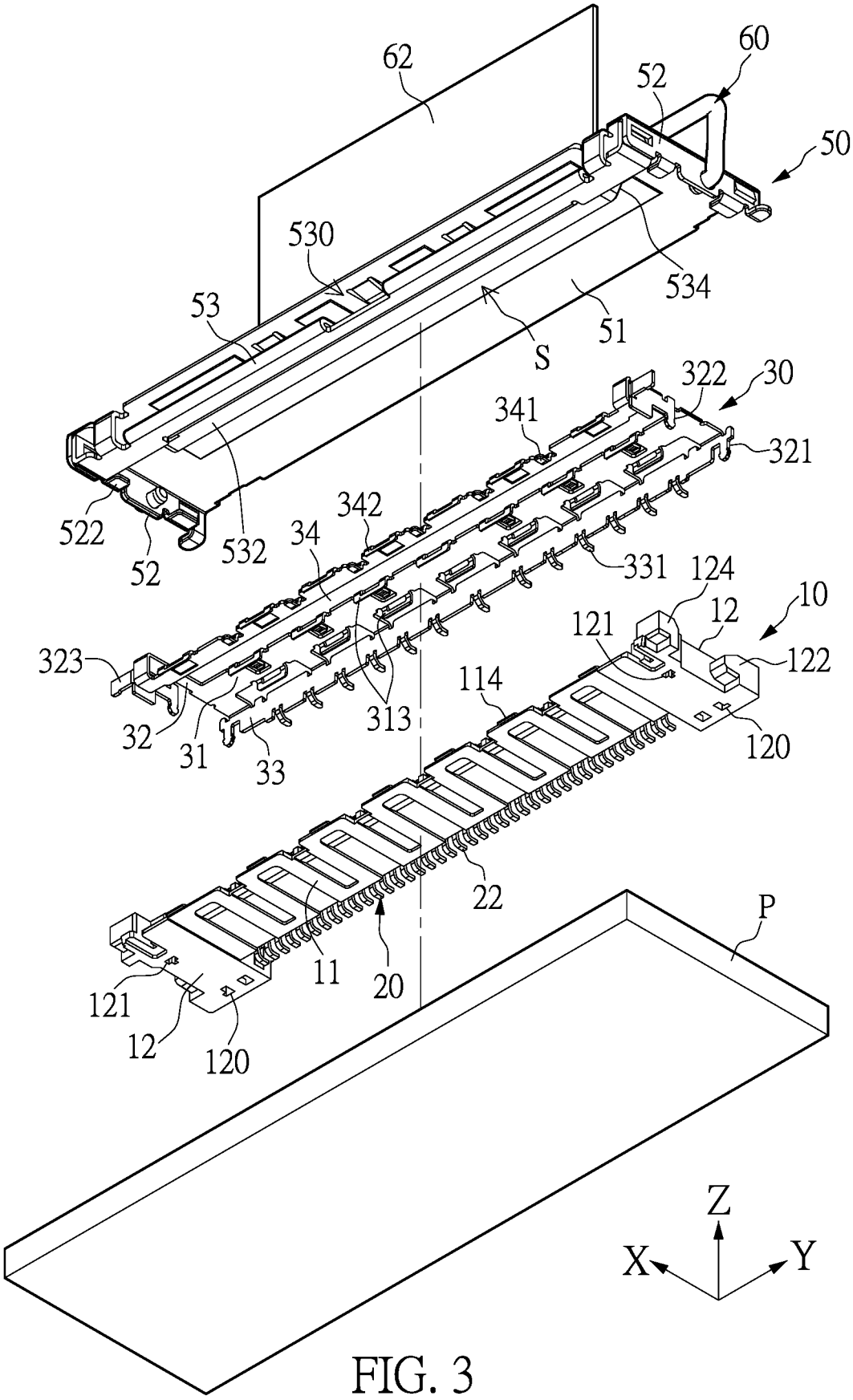
FIG. 3 is an exploded perspective view taken from another angle of the cable connector of the present disclosure.
Figure 4:
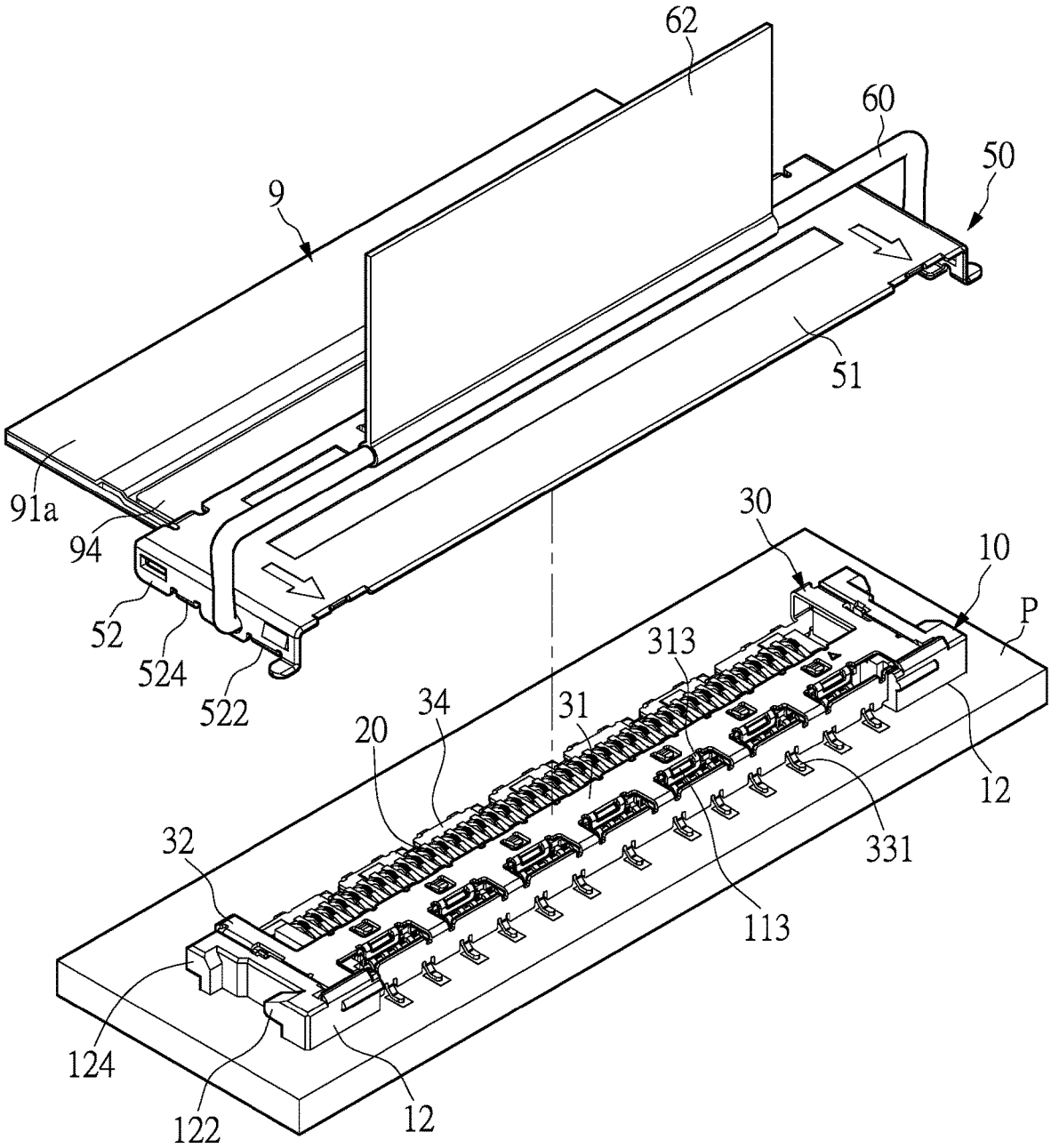
FIG. 4 is a perspective view of the cable connector and the cable plug of the present disclosure before the cable connector and the cable plug are assembled.

A detailed structure of the metal frame 30 is as follows. As shown in FIG. 2 and FIG. 3, the metal frame 30 has a horizontal top wall 31, a pair of frame side walls 32, a front wall 33, and a rear wall 34. The pair of frame side walls 32 is connected to two opposing sides of the horizontal top wall 31 and extends in a backward direction, and is fixed to a pair of shoulder portions 12 of the insulated body 10. The front wall 33 is formed by bending a front edge of the horizontal top wall 31 downward and has a plurality of first pins 331 (as shown in FIG. 2) that are fixed to the circuit board P by soldering. The rear wall 34 is connected to the pair of frame side walls 32 and a height of the rear wall 34 is lower than a height of the horizontal top wall 31. The rear wall 34 has a plurality of second pins 341 (as shown in FIG. 3) that extend in the backward direction and are fixed to the circuit board P by soldering. Specifically, the horizontal top wall 31 and the front wall 33 shield a frontal half portion of the terminals 20. The first pins 331 extend in the forward direction from a bottom edge of the front wall 33 and are arranged in parallel with each other at a front side of the soldering portions 22 of the terminals 20. The second pins 341 extend in the backward direction from a bottom edge of the rear wall 34 and are arranged in parallel with each other at a rear side of the contact portion 21 of the terminals 20.

The shielding conductive body 50 of the current embodiment is detachably assembled to the insulated body 10 and positioned above the metal frame 30. Referring to FIG. 2 and FIG. 3, the shielding conductive body 50 has a front portion 53, a shielding top wall 51, and a pair of shielding side walls 52. The front portion 53, the shielding top wall 51, and the pair of shielding side walls 52 cooperatively form a cable receiving chamber S. The front portion 53 has a cable entrance 530 formed thereon, and the front portion 53 contacts a bottom surface of the cable 9. Referring to FIG. 1A, the shielding top wall 51 has a plurality of elastic arms 512 formed thereon that are elastically extended inward into the cable receiving chamber S, such that the plurality of elastic arms 512 contacts a top surface of the cable 9.

The cable 9 of the current embodiment is, for example, a single layered flexible flat cable (FFC). Referring to FIGS. 1A and 1B, the cable 9 has an insulated substrate 90 disposed therebetween, a plurality of conductive bodies 95 are fixedly disposed in the insulated substrate 90, and a reinforcing plate 93 is covered upon a top surface of a front end of the insulated substrate 90. An upper shielding layer 91*a* is entirely covered upon top surfaces of the reinforcing plate 93 and the insulated substrate 90, and a lower shielding layer 91*b* is entirely covered upon a bottom surface of the insulated substrate 90. The present disclosure is not limited to being applied to the aforementioned cables. For example, the present disclosure may be applied to a flexible print circuit (FPC) cable, such that a top and a bottom surface of the FPC cable each have a shielding layer covered upon. Moreover, the present disclosure is not limited to being applied to a single-layered FPC cable, for example, the present disclosure may also be applied to a cable with a double-layered conductive body, or an FPC.

The front end of the cable 9 may be covered by a covering plate 94 for strengthening a structural rigidity of the front end of the cable 9, so that the front end of the cable 9 is less prone to deformation. In a preferable embodiment, the upper shielding layer 91*a* entirely covers a top surface of the cable 9, and a top surface of a front end of the upper shielding layer 91*a* has a covering plate 94 thereon, which is electrically conductive. The elastic arms 512 of the shielding conductive body 50 are in contact with the covering plate 94. The lower shielding layer 91*b* entirely covers a bottom surface of the cable 9, and the front portion 53 of the shielding conductive body 50 is in contact with the lower shielding layer 91*b*. The upper shielding layer 91*a* and the lower shielding layer 91*b* may be made of a metal foil, such as an aluminum foil that respectively covers upon the top surface and the bottom surface of the cable 9. The covering plate 94 may be fixed to the shielding conductive body 50 by soldering. However, the covering plate 94 of the cable 9 may be omitted to allow the elastic arms 512 of the shielding conductive body 50 to be in direct contact with the top surface of the front end of the upper shielding layer 91*a*.

In the current embodiment, the pull rod 60 is arranged to facilitate convenient assembly and removal of the shielding conductive body 50. Referring to FIG. 1A and FIG. 1B, the pull rod 60 is rotatably connected to the shielding conductive body 50. Specifically, the pull rod 60 is substantially in the shape of the letter U, and two ends of the pull rod 60 are pivotally connected to the pair of shielding side walls 52, respectively. The pull rod 60 may be rotated to a fastened position and be fastened to the cable socket, that is to say, the pull rod 60 may be rotated to a front end of the insulated body 10 and be fastened to the insulated body 10 and so the shielding conductive body 50 is fastened to the insulated body 10. The present embodiment further includes a pull tab 62 connected to the pull rod 60 for the pull rod 60 to be conveniently rotated by users.

Detailed processes of fixing the metal frame 30 and the insulated body 10 are as follows. Referring to FIG. 2 and FIG. 3, two opposing sides of the metal frame 30 are inserted and fixed to two opposing sides of the insulated body 10. Each of the pair of shoulder portions 12 of the insulated body 10 has two through slots 120 and 121 formed thereon along a second direction, and the second direction is perpendicular to the first direction. In other words, the second direction is a direction along the Z-axis. The two opposing sides of the metal frame 30 each have two fixing sheets 321 and 322 formed thereon. Specifically, each of the frame side walls 32 extends downward to form the two fixing sheets 321 and 322. The two fixing sheets 321 and 322 are respectively and fixedly inserted into the two through slots 120 and 121.

Referring to FIG. 2 and FIG. 3, a top portion of the metal frame 30 is fastened to a top portion of the insulated body 10, and the horizontal top wall 31 of the metal frame 30 is fixedly assembled to the main portion 11 of the insulated body 10. Specifically, the main portion 11 of the insulated body 10 has a plurality of first fastening protrusions 113. The plurality of first fastening protrusions 113 protrude in the forward and backward directions from a top portion of the main portion 11. The horizontal top wall 31 of the metal frame 30 has a plurality of first fastening hooks 313. Specifically, a rear edge of the horizontal top wall 31 is bent downward to form the plurality of first fastening hooks 313 that are in a shape of a rectangular frame. In addition, a portion of the horizontal top wall 31 that is close to the front wall 33 is stamped downward to form the plurality of first fastening hooks 313 that are in a shape of a rectangular frame. The plurality of first fastening protrusions 113 of the insulated body 10 are correspondingly fastened to the plurality of first fastening hooks 313 of the metal frame 30.

In addition, a rear end of the metal frame 30 is fastened to a rear end of the insulated body 10, wherein the main portion 11 of the insulated body 10 has a plurality of second fastening protrusions 114. The plurality of second fastening protrusions 114 are positioned at a rear side of the terminal slots 110. Specifically, the plurality of second fastening protrusions 114 are formed at a rear edge of the main portion 11. The rear wall 34 of the metal frame 30 has a plurality of second fastening hooks 342, and the plurality of second fastening protrusions 114 of the insulated body 10 are respectively fastened to the plurality of second fastening hooks 342 of the metal frame 30. The second fastening hooks 342 of the present embodiment are also in a shape of a rectangular frame, but the present disclosure is not limited thereto. Referring to FIG. 2, each of the frame side walls 32 of the metal frame 30 further extends outward to form a rear positioning plate 323. The rear positioning plate 323 abuts against one of the shoulder portions 12 of the insulated body 10, but the present disclosure is not limited thereto. The main portion 11 may have a plurality of fastening protrusions, and the metal frame 30 may have a plurality of fastening hooks.

Detailed processes of assembling the shielding conductive body 50 and the insulated body 10 are as follows. Referring to FIG. 2, each of both sides in the front edges of the shielding top wall 51 has a positioning recessed portion 510 formed thereon. An upper block 125 protrudes upward from each of the shoulder portions 12 of the insulated body 10, and the upper block 125 passes through a top surface of the metal frame 30 when the metal frame 30 is fixed to the insulated body 10. When the shielding conductive body 50 is assembled to the insulated body 10, the upper block 125 is located in the positioning recessed portion 510.

Figure 6:
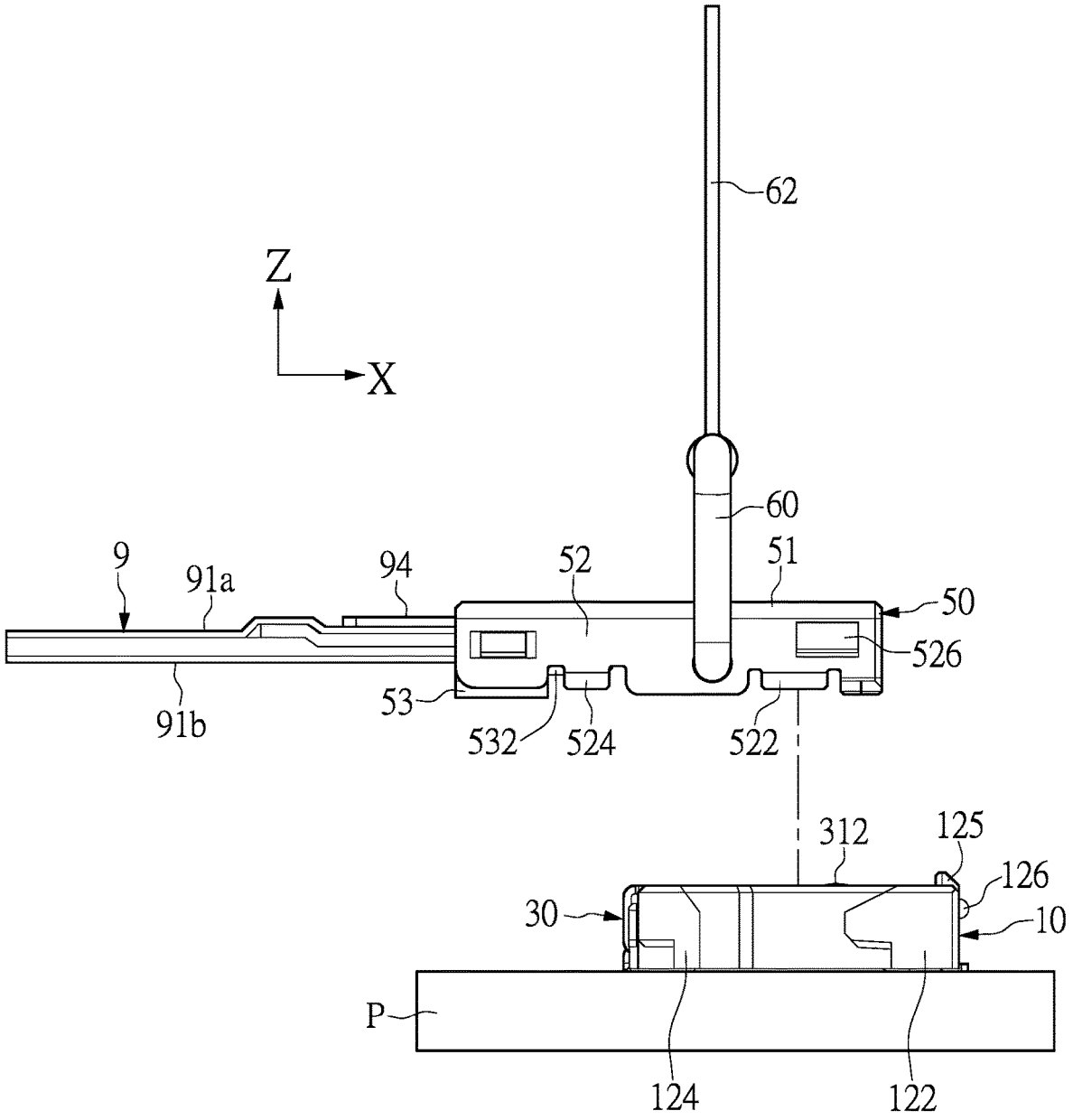
FIG. 6 is a side view of the cable connector and the cable plug of the present disclosure before the cable connector and the cable plug are assembled.

Referring to FIG. 2, FIG. 3 and FIG. 6, a front end surface of the shoulder portion 12 of the insulated body 10 has a blocking member 126 formed thereon. When the shielding conductive body 50 is assembled to the insulated body 10, the pull rod 60 may be rotated to a fastened position so as to be fastened to the blocking member 126 of the shoulder portion 12. In the present embodiment, when the pull rod 60 is rotated to a fastened position, the pull rod 60 is fixedly fastened to the insulated body 10, thereby restricting the shielding conductive body 50 from moving backward along the direction of the X-axis. In other words, the shielding conductive body 50 and the cable 9 may be prevented from being detached from the cable socket (that is, the insulated body 10 and the metal frame 30). The quantity of the blocking member 126 may be at least one, but the present disclosure is not limited thereto. In addition, referring to FIG. 2 and FIG. 8, each of the shielding side walls has a side protruding block 526 protruding outward, and a side of the pull rod 60 is fixedly fastened to the side protruding block 526. This arrangement may strengthen a fastened state of the pull rod 60 to avoid an occurrence of accidental rotation of the pull rod 60.

Figure 8:
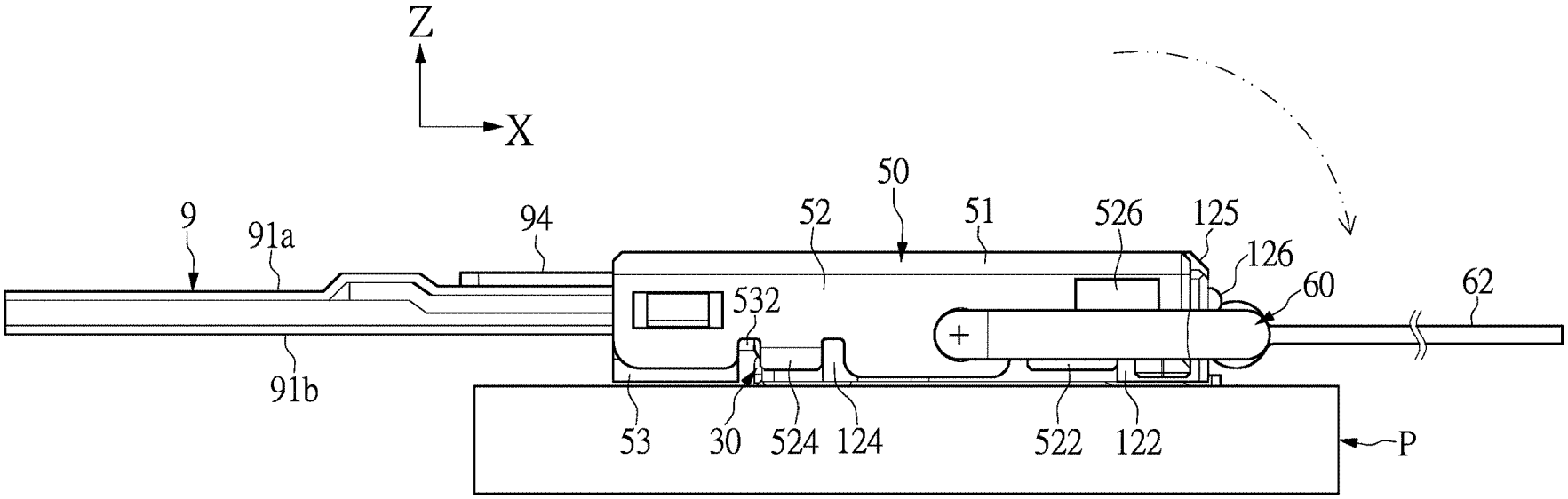
FIG. 8 is a side view of an assembly of the shielding conductor, in which the pull rod is at a fastened position, and the cable socket of the present disclosure.
Figure 9:
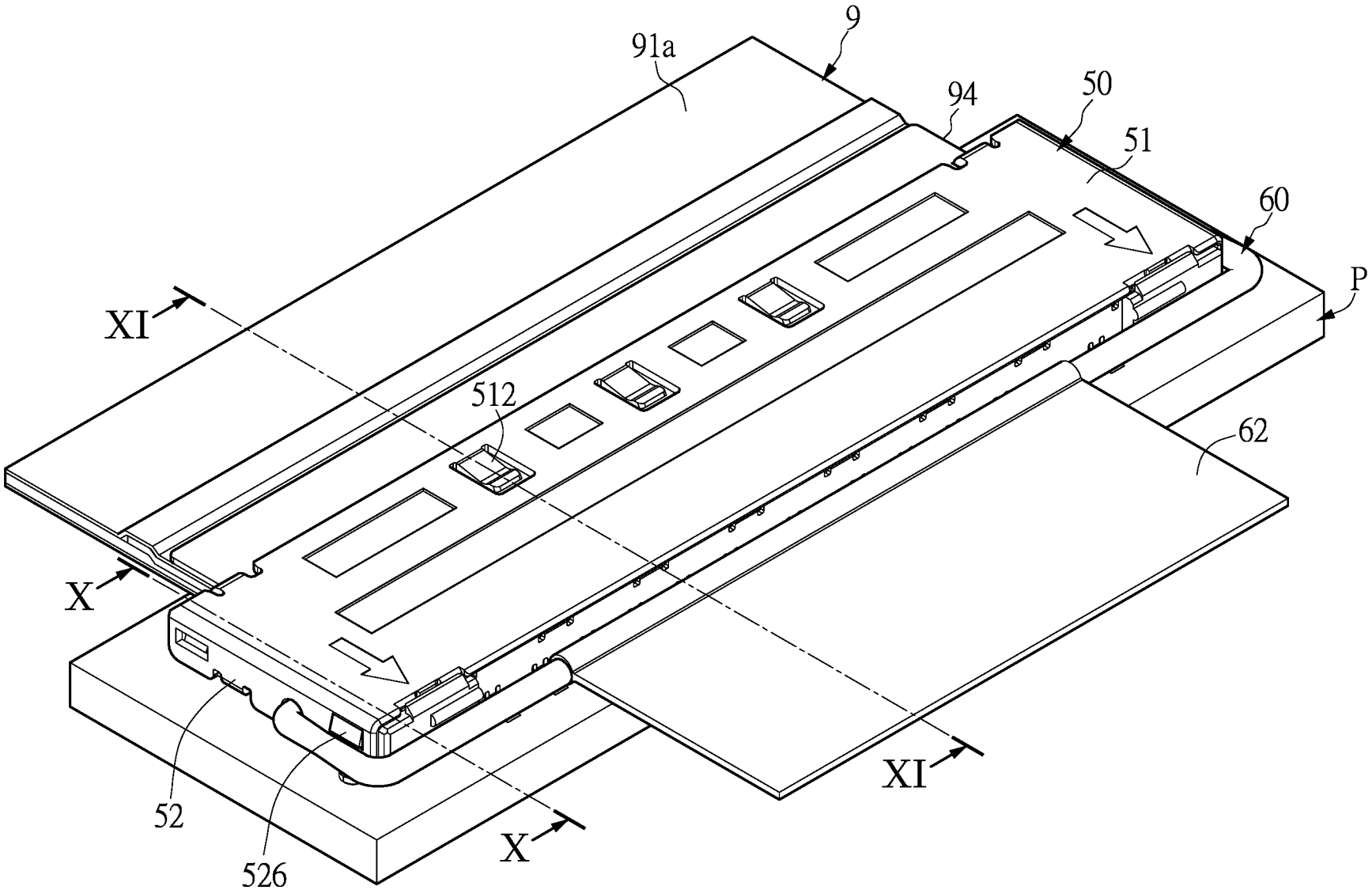
FIG. 9 is a perspective view of the cable connector and the cable plug of the present disclosure after the cable connector and the cable plug are assembled.
Figure 10:
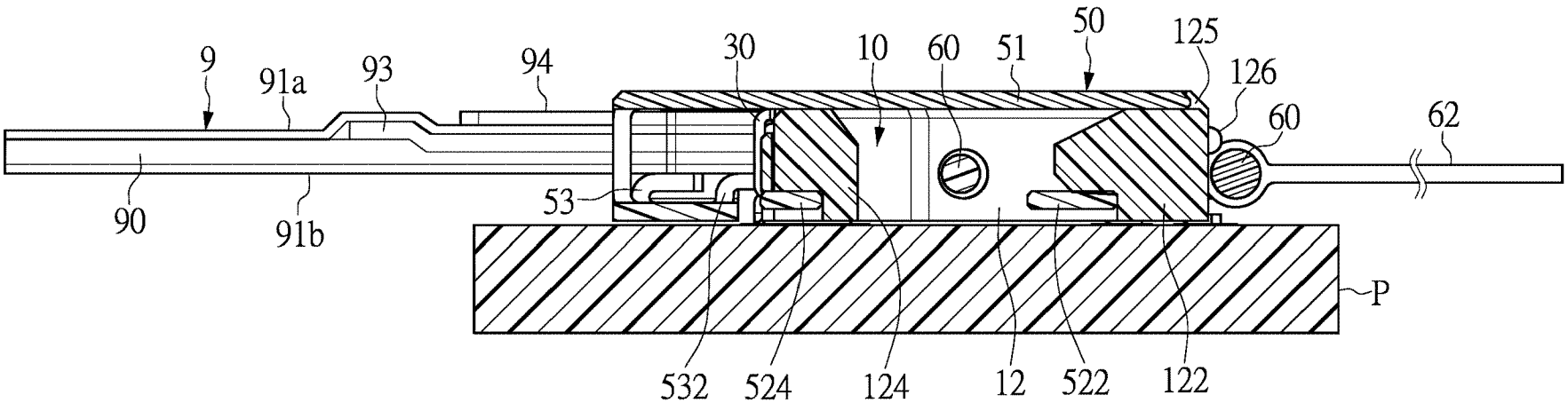
FIG. 10 is a sectional view taken along line X-X of FIG. 9.

Referring to FIG. 2, FIG. 6 and FIG. 10, for the purpose of restricting the shielding conductive body 50 from moving along the direction of the Z-axis, the outer side surface of the shoulder portions 12 of the insulated body 10 has a front limiting protrusion 122 and a rear limiting protrusion 124 formed thereon, and bottom edges of each of the shielding side wall 52 extend inward to form a front limiting tab 522 and a rear limiting tab 524. Referring to FIG. 8 and FIG. 9, when the shielding conductive body 50 is assembled to the insulated body 10, the front limiting tab 522 enters a bottom side of the front limiting protrusion 122, and the rear limiting tab 524 enters a bottom side of the rear limiting protrusion 124, thereby limiting the shielding conductive body 50 from moving along the direction of the Z-axis, but the present disclosure is not limited thereto. The quantity of the limiting protrusions of the shoulder portions 12 may be at least one, and quantities of the limiting tabs of the shielding conductive body 50 may be at least one. Each of the shielding side walls 52 abuts against one of the shoulder portions 12 of the insulated body 10 for limiting the shielding conductive body 50 from moving along the direction of the Y-axis. Therefore, when the pull rod is rotated to a fastened position, the shielding conductive body 50 is fastened to the insulated body 10.

Figure 5:
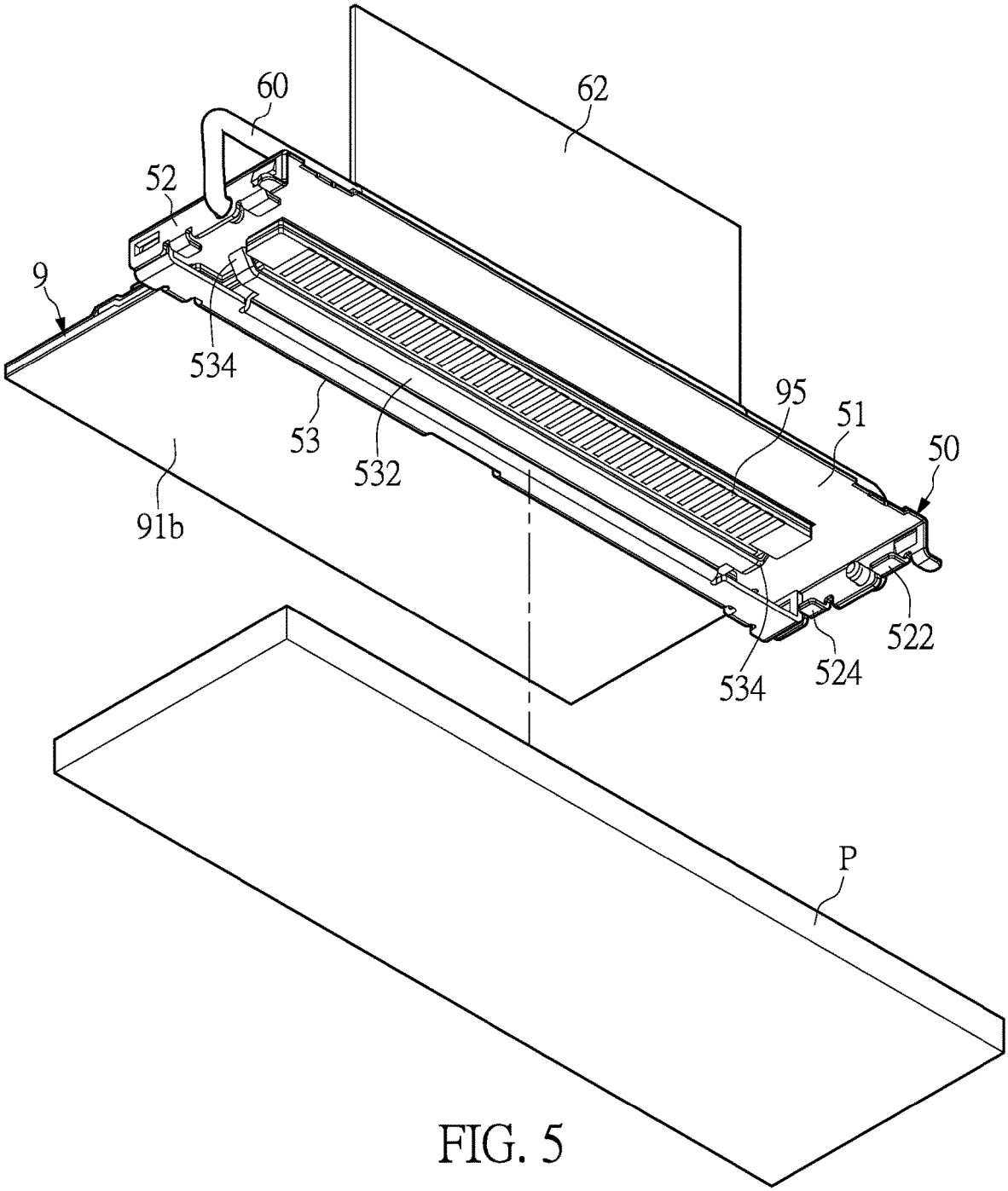
FIG. 5 is a perspective view taken from another angle of the cable connector and the cable plug of the present disclosure before the cable connector and the cable plug are assembled.
Figure 11:
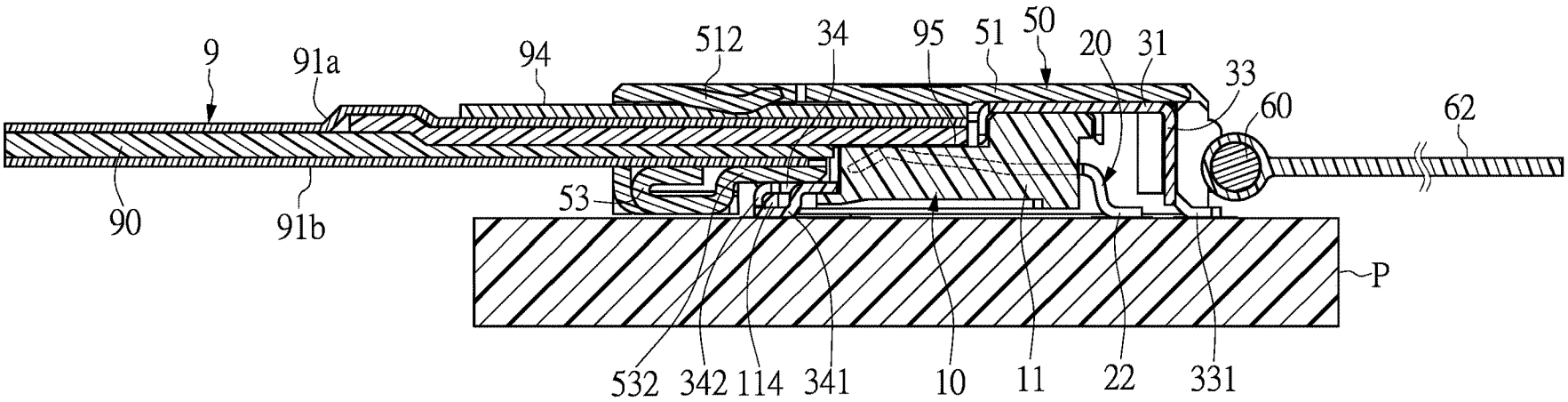
FIG. 11 is a sectional view taken along line XI-XI of FIG. 9.

Detailed processes of assembling the cable 9 to the cable socket of the present embodiment are as follows. Firstly, the cable 9 is assembled to the shielding conductive body 50. Referring to FIG. 3 and FIG. 5, the front end of the cable 9 is inserted into the shielding conductive body 50 via the cable entrance 530 of the shielding conductive body 50. Further, the front portion 53 of the shielding conductive body 50 extends inward to form a supporting wall 532. Referring to FIG. 11, a top surface of the supporting wall 532 is parallel to the first direction and substantially flush with a top surface of the front portion 53. The upper shielding layer 91*a* and the covering plate 94 is electrically connected with the elastic arms 512 of the shielding conductive body 50, and the lower shielding layer 91*b* is electrically connected to the supporting wall 532. Referring to FIG. 5, two ends of the supporting wall 532 respectively extend toward the shielding top wall 51 to form a side blocking portion 534 for blocking a pair of side recessed portions 92 of the cable 9 such that the cable 9 is fixed to the shielding conductive body 50. In other words, the side blocking portion 534 serves as a cable fixing portion, that can fix one cable inserted along the first direction. Furthermore, for enhancing the fixing effect, the cover plate 94 may extend to a rear side of the side recessed portion 92. The structural design of the present embodiment prevents the cable 9 from being detached outward from the shielding conductive body 50 when the cable 9 is assembled to the cable socket.

Figure 7:
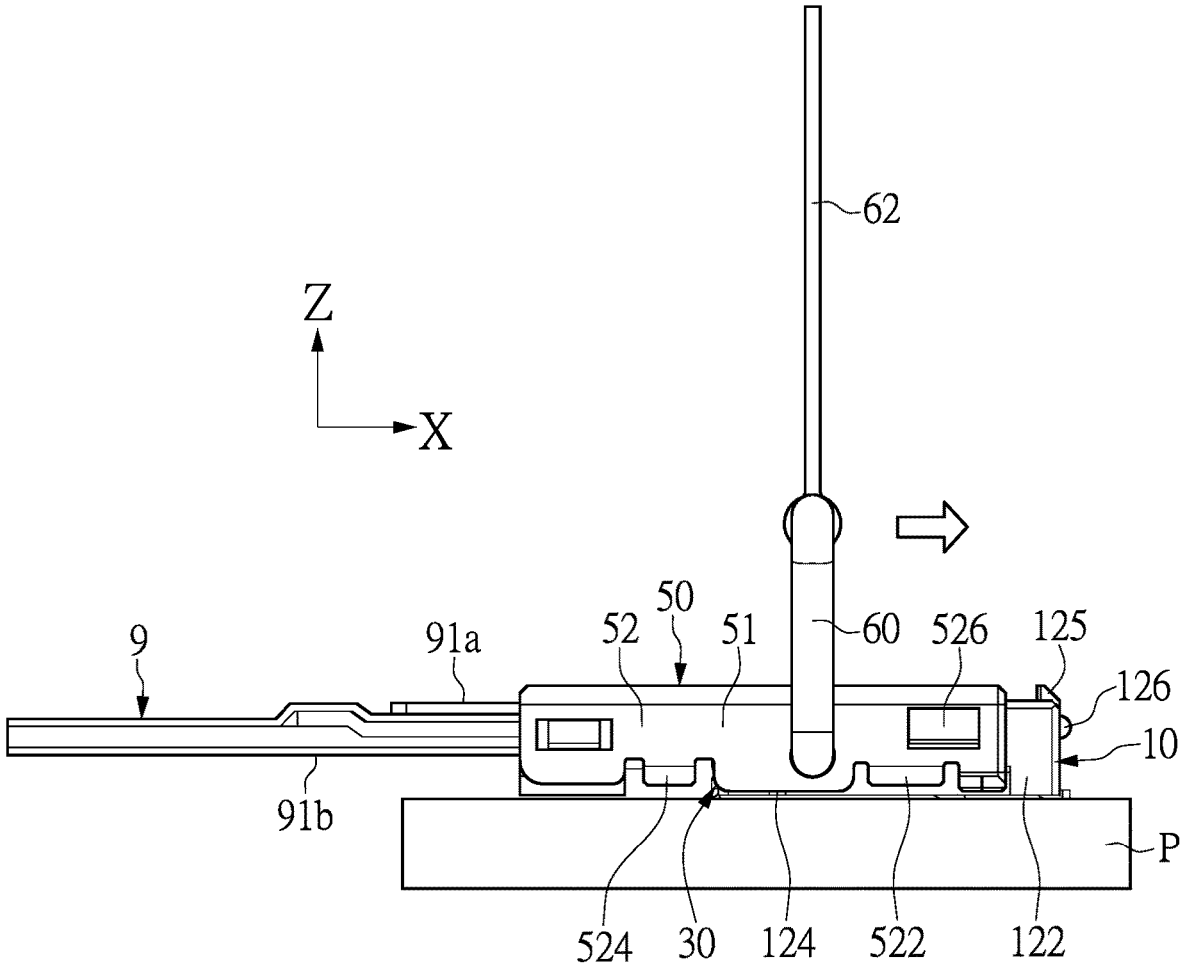
FIG. 7 is a side view of an initial assembly of the shielding conductor and the cable socket of the present disclosure.

Referring to FIG. 6 and FIG. 7, the cable 9 and the shielding conductive body 50 are placed downward along a direction perpendicular to the circuit board P, that is, a direction of a negative Z-axis, on the insulated body 10 and the metal frame 30 (that is, the cable socket). During this process, the front limiting protrusion 122 and the rear limiting protrusion 124 constitute a guiding installation portion, and the front limiting tab 522 of the shielding conductive body 50 serves as a guided portion. In the process of placing the shielding conductive body 50 down on the cable socket, the guided portion is limited by the guiding installation portion to slide downward along the Z-axis for a predetermined distance until a predetermined height is reached.

Referring to FIG. 7 and FIG. 8, the shielding conductive body 50 and the cable 9 are moved in the forward direction (a direction along the X-axis referring to FIG. 7), so that the shielding conductive body 50 is fastened to a side of the insulated body 10.

Finally, referring to FIG. 8 and FIG. 9, the pull rod 60 is rotated forward, that is, rotated along a clockwise direction as shown in FIG. 8, to be fastened to the insulated body 10. The assembly process is therefore completed. At this time, the contact portions 21 of the terminals 20 are respectively in physical contact with the corresponding plurality of conductive bodies 95 of the cable 9 so as to be electrically connected thereto.

In this embodiment, to remove the cable 9 from the cable socket, as illustrated in FIG. 8, the pull rod 60 is rotated upward, that is, a counter-clockwise movement in FIG. 8, so as to disengage the pull rod 60 from the insulated body 10.

The shielding conductive body 50 and the cable 9 are then pulled backward (along a negative X-axis direction as shown in FIG. 7) so as to disengage the shielding conductive body 50 from the insulated body 10. Finally, the shielding conductive body 50 and the cable 9 can be pulled upward.

Referring to FIG. 11, based on the aforementioned arrangements in the present disclosure, when the shielding conductive body 50 is assembled to the insulated body 10, the front portion 53 of the shielding conductive body 50 physically contacts the metal frame 30. Furthermore, a top end of the horizontal top wall 31 of the metal frame 30 is electrically connected to the shielding top wall 51 of the shielding conductive body 50. Preferably, a rear wall 34 of the metal frame 30 is also electrically connected to the supporting wall 532 of the shielding conductive body 50. Referring to FIG. 2 and FIG. 6, the horizontal top wall 31 of the metal frame 30 of the present embodiment has a plurality of conductive elastic arms 312 formed thereon. The plurality of conductive elastic arms 312 are in contact with the shielding top wall 51 of the shielding conductive body 50 so that the metal frame 30 is electrically connected to the shielding conductive body 50. The upper shielding layer 91*a* and the lower shielding layer 91*b* of the cable 9 are both in physical contact or electrically connected with the metal frame 30 through the shielding conductive body 50, and then are electrically connected to the grounding circuit (omitted in the figures) of the circuit board P through the metal frame 30. Furthermore, the front end of the cable 9 is surrounded by the shielding conductive body 50 and the metal frame 30 so as to form a good shielding effect, thereby achieving a good resistance against EMI.

In conclusion, one of the advantages of the present disclosure is that, in the full-shielding cable connector of the present disclosure, the cable does not require an additional grounding process to ground the covering metal foil, and the connector does not need additional grounding terminals to be in contact with the cable. By the shielding conductive body 50 and/or the metal frame 30 being in physical contact with the shielding layers of the top surface and the bottom surface of the cable 9, the present disclosure allows a good electrical connection between the cable and the grounding circuit of the circuit board, and achieves a full-shielding function that provides resistance against EMI.

Another advantage of the present disclosure is that, the cable is perpendicular to the direction of the Z-axis of the circuit board, and is inserted from top to bottom into the cable connector. In addition, a simple pull rod 60 is used to fix the cable to the cable connector. Therefore, an installation process of the cable is simplified and the correctness of the installation is ensured.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A full-shielding cable connector that is electrically connected to a circuit board, the full-shielding cable connector comprising:

an insulated body having a plurality of terminal slots formed along a first direction;

a plurality of terminals being respectively received in the plurality of terminal slots, wherein each of the plurality of terminals has a contact portion and a soldering portion, and the soldering portion extends from the contact portion;

a metal frame being fixed to the insulated body, wherein the metal frame has a plurality of pins so as to be electrically connected to the circuit board;

a shielding conductive body being detachably assembled to the insulated body and arranged above the metal frame, wherein the shielding conductive body has a cable entrance such that when a front end of a cable enters the shielding conductive body through the cable entrance, an upper shielding layer and a lower shielding layer of the cable are electrically connected to the shielding conductive body; and a pull rod being rotatably connected to the shielding conductive body, wherein when the pull rod is rotated to a fastened position, the pull rod is fastened to the insulated body;

wherein when the shielding conductive body is assembled to the insulated body, the shielding conductive body physically contacts the metal frame;

wherein the insulated body has a blocking member, and when the shielding conductive body is assembled to the insulated body and the pull rod is rotated to the fastened position, the pull rod is fastened by the blocking member.

2. The cable connector according to claim 1, wherein the insulated body has a main portion and a pair of shoulder portions, the pair of shoulder portions are respectively connected to two opposite sides of the main portion, each one of the pair of the shoulder portions has at least one through slot formed thereon along a second direction, and the second direction is perpendicular to the first direction; wherein each of two opposite sides of the metal frame respectively has at least one fixing sheet formed thereon, and the at least one through slot is configured to receive the at least one fixing sheet.

3. The cable connector according to claim 2, wherein the main portion of the insulated body has a plurality of fastening protrusions, the metal frame has a horizontal top wall that has a plurality of fastening hooks, and the plurality of fastening protrusions and the plurality of fastening hooks correspondingly are fastened with each other.

4. The cable connector according to claim 1, wherein the metal frame has a horizontal top wall, a front wall and a rear wall, the front wall is formed by a front edge of the horizontal top wall is bent downward to form the front wall that has a plurality of first pins fixed to the circuit board by soldering, and the rear wall has a plurality of second pins extending toward a rear side and being fixed to the circuit board by soldering.

5. The cable connector according to claim 1, wherein the shielding conductive body has a shielding top wall, the cable entrance extends inward to form a supporting wall, and two ends of the supporting wall respectively extends toward the shielding top wall to form a side blocking portion to block a pair of side recessed portions of the cable.

6. The cable connector according to claim 5, wherein the cable includes a cover plate, and the cover plate is arranged at the front end of the cable and extends to rear sides of the side recessed portions.

7. The cable connector according to claim 5, wherein the supporting wall has a top surface that is parallel to the first direction and electrically connected with the lower shielding layer of the cable.

8. The cable connector according to claim 1, wherein the insulated body has a main portion and a pair of shoulder portions, the pair of shoulder portions are respectively connected to two opposite sides of the main portion, each one of the pair of the shoulder portions has at least one limiting protrusion formed on an outer side surface thereof, bottom edges of both side walls of the shielding conductive body extends inward to correspondingly form at least one limiting tab, and when the shielding conductive body is assembled to the insulated body, the at least one limiting tab enters a bottom side of the corresponding limiting protrusion.

9. A cable plug being detachably assembled to a full-shielding cable connector, wherein the cable connector includes an insulated body and a metal frame, and the insulated body receives a plurality of terminals, the cable plug comprising:

a shielding conductive body being detachably assembled to the insulated body and arranged above the metal frame, the shielding conductive body having a front portion, a shielding top wall and a pair of shielding side walls, wherein a cable receiving chamber is formed therebetween, a cable entrance is formed on the front portion and contacts a bottom surface of a cable inserted therein, and the shielding top wall has a plurality of elastic arms formed thereon and extended inward into the cable receiving chamber such that the plurality of elastic arms contact a top surface of the cable; and a pull rod, rotated with respect to the shielding conductive body and when the pull rod is rotated to a fastened position, the shielding conductive body is fastened to the insulated body;

wherein when the shielding conductive body is assembled to the insulated body, the front portion of the shielding conductive body is in physical contact with the metal frame;

wherein the front portion of the shielding conductive body further extends inward to form a supporting wall, and two ends of the supporting wall respectively extend toward the shielding top wall to form a side blocking portion to block a pair of side recessed portions of the cable.

10. The cable plug according to claim 9, further comprising a pull tab connected to the pull rod.

11. The cable plug according to claim 9, wherein two ends of the pull rod are pivotally connected to two shielding side walls of the shielding conductive body.

12. A full-shielding cable connector that is electrically connected to a circuit board, the full-shielding cable connector comprising:

a cable socket including an insulated body and a metal frame, the insulated body receives a plurality of terminals; and a shielding conductive body being detachably assembled to the cable socket, and the shielding conductive body includes a cable fixing portion to fix a cable inserted therein in place along a first direction;

wherein the cable socket has at least one guiding installation portion, the shielding conductive body has at least one guided portion, and when the shielding conductive body is assembled to the cable socket, the at least one guided portion, being limited by the corresponding guiding installation portion, slides along a second direction for a predetermined distance, and the second direction is perpendicular to the first direction;

wherein when the cable is fixed in place by the shielding conductive body, an upper shielding layer and a lower shielding layer of the cable are in physical contact with the shielding conductive body.

13. The cable connector according to claim 12, further including a pull rod rotatably connected to the cable socket, and when the pull rod is rotated to a fastened position, the pull rod is fastened to the cable socket.

14. The cable connector according to claim 12, wherein the shielding conductive body has a side blocking portion corresponding to a pair of side recessed portions of the cable to fix the cable in place.

15. The cable connector according to claim 12, wherein the metal frame has a plurality of pins that are electrically connected to the circuit board.

16. The cable connector according to claim 15, wherein when the shielding conductive body is assembled to the cable socket, the shielding conductive body is in physical contact with the metal frame.

* * * * *